US005211389A

United States Patent [19]

Roch et al.

[11] Patent Number: 5,211,389

[45] Date of Patent: May 18, 1993

[54] REMOVABLE STACKING DEVICE FOR AUTOMATIC MAIL SORTING MACHINE

[75] Inventors: Olivier Roch, Valence; Frédéric Mestrallet, Etoile, both of France

[73] Assignee: Compagnie Generale d'Automatisme CGA-HBS, Bretigny-Sur-Orge, France

[21] Appl. No.: 777,006

[22] Filed: Oct. 16, 1991

[30] Foreign Application Priority Data

Oct. 16, 1990 [FR] France ..... 90 12750

[51] Int. Cl.[5] ..... B65H 31/06; B65H 31/22

[52] U.S. Cl. ..... 271/207; 271/214; 271/220; 414/789.9

[58] Field of Search ..... 271/207, 214, 220; 414/789.9

[56] References Cited

U.S. PATENT DOCUMENTS

| | | | |
|---|---|---|---|
| 3,729,191 | 4/1973 | Yoshimura et al. . | |
| 3,865,365 | 2/1975 | Hardin et al. | 271/214 |
| 4,518,160 | 5/1985 | Lambrechts et al. | 271/214 |
| 4,732,375 | 3/1988 | Tetherton | 271/220 |
| 5,044,877 | 9/1991 | Constant et al. | 414/798.9 |
| 5,092,575 | 3/1992 | Ramsey | 271/207 |

FOREIGN PATENT DOCUMENTS

| | | |
|---|---|---|
| 1234067 | 2/1967 | Fed. Rep. of Germany . |
| 2552743 | 4/1985 | France . |
| 61-91936 | 5/1986 | Japan . |
| 839786 | 6/1960 | United Kingdom . |

*Primary Examiner*—Robert P. Olszewski
*Assistant Examiner*—Steven M. Reiss
*Attorney, Agent, or Firm*—Sughrue, Mion, Zinn, Macpeak & Seas

[57] ABSTRACT

A removable stacker for automatic mail sorting system comprises a stacking area, a mobile wall adapted to hold documents on edge and to move against the action of a return device as the stacker is filled and an articulated flap adapted to assume a first position in which it is retracted and a second position in which it cooperates with the mobile wall to grip the documents during manipulation of the removable stacker. A system is provided for maintaining the flap in its second position against the action of the weight of the stacked documents.

4 Claims, 4 Drawing Sheets

REMOVABLE STACKING DEVICE FOR AUTOMATIC MAIL SORTING MACHINE

BACKGROUND OF THE INVENTION

1. Field of the Invention

The present invention concerns a stacking device for automatic mail sorting machines.

2. Description of the Prior Art

An automatic mail sorting machine usually comprises the following parts:

- a feed magazine in which an operator places mail to be sorted and which is then put in front of an unstacker,
- an unstacker whose function is to separate the letters so as to feed them one by one to a conveyor
- a read head associated with a microprocessor and facing the conveyor system to identify each letter and to assign it a storage area representative of its final destination, these storage areas being pigeonholes and/or stackers,
- a series of pigeonholes or stackers varying in number according to the machine and which serve as receptacles for the previously sorted letters. Each pigeonhole or stacker represents a specific sorting destination.

The present invention is more particularly concerned with the stacker which is so called because the letters are stored one against another to constitute a stack.

The widespread adoption of automatic mail processing has lead to the production of sorting machines for small sorting centers which carry out operations known as routing sorting and distribution sorting, which is the last stage of sorting before distribution to the addressees by the mailman.

Problems have been encountered with regard to the overall size of the machines and in response attempts have been made to optimize the number of sorting directions and consequently the number of stackers or pigeonholes in the machine. It has been found that routing sorting and distribution sorting can be carried out on a machine having less sorting receptacles than previously, provided that the number of sorting passes is increased.

The cost-effectiveness of the machines then depends on strict management of operation:

- reducing wasted time,
- eliminating unnecessary manipulation of the mail,
- reducing the number of operators,
- etc.

The greatest improvement in productivity can be obtained in distribution sorting, also known as delivery preparation. Delivery preparation means sorting and storing the mail in an order that must not thereafter be varied: the order of the mail items must correspond exactly to the mailman's route.

The number of successive sorting runs depends on the number of letters to sort, the sorting method adopted, the number of destinations, etc.

In addition to the problems of cost-effectiveness mentioned above, there is that of ensuring the quality of mail sorting, implying strict respect for the order of the letters throughout the sorting process.

One object of the present invention is to propose a sorting machine stacker for optimum stacking and transfer under the conditions currently prevailing in small sorting centers, namely:

- restricted available space, implying a machine with small overall dimensions,
- machines for use by a single operator, with the aim of increasing cost-effectiveness by eliminating unnecessary manipulation of the mail, reducing the risk of incorrect manipulation, reducing wasted time and guaranteeing the quality of sorting by respecting the ordering of the mail items.

SUMMARY OF THE INVENTION

The present invention consists in a removable stacker for automatic mail sorting system comprising a stacking area, a mobile wall adapted to hold documents on edge and to move against the action of a return device as the stacker is filled and an articulated flap adapted to assume a first position in which it is retracted and a second position in which it cooperates with said mobile wall to grip said documents during manipulation of the removable stacker, said flap comprising means for maintaining it in said second position against the action of the weight of the stacked documents.

In a first embodiment of the invention said means comprise a magnet fixed to said flap and cooperating with a fixed magnetic member.

In an alternative embodiment of the invention said means comprise a magnet placed on a fixed member and cooperating with said flap at least part of which is made from a magnetic material.

The stacker advantageously comprises at least one manipulator handle.

The invention will be better understood from the following description of one embodiment of the invention given with reference to the appended drawings.

DETAILED DESCRIPTION OF THE INVENTION

The removable stacker in accordance with the invention comprises a stacking area in which a stack of sorted letters is formed with each letter vertical, on edge and against the previous letter. This area is defined by a rectangular plate 1 made from aluminum or any other lightweight material having a low coefficient of friction and sufficient stiffness.

To give a numerical example, the plate is 535 mm long by 275 mm wide providing a capacity of several hundred letters of ordinary size. A thickness of 2 mm ensures adequate stiffness combined with light weight. Of course, these dimensions can be varied according to the dimensional specifications of the documents to be processed and the type of machine in which the stacker is used.

The plate 1 is closed along one sorter edge by a vertical plate 2 in which is a hole 3 sufficiently large to act as a handle.

The stacker also has a mobile wall 4 against which the first stacked letter rests and the function of which is to keep the letters on edge as it moves as the stacker is filled.

Figure 1:
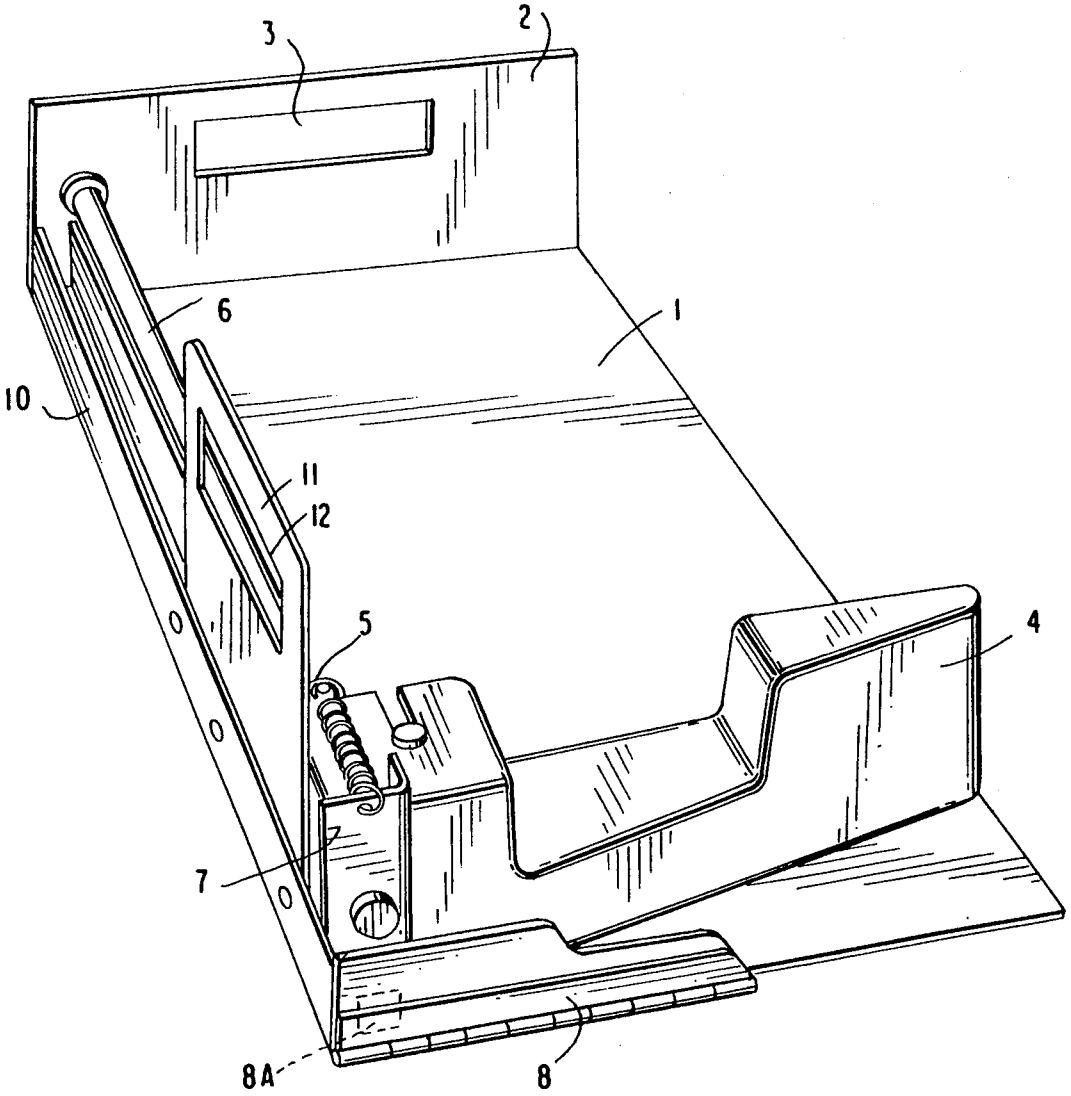
FIG. 1 is a perspective view of the stacker in accordance with the invention, shown empty.

This wall is provided with a return device for holding the mail adequately and for returning it to its start position (that shown in FIG. 1) when the contents of the stacker have been removed.

The mobile wall is a blade-like member fitted with a ball bearing type bush 5 (see FIG. 2) sliding on a rod 6 parallel to one of the longer sides of the plate 1 and fixed to the plate 2 and to an angle-bracket 7 fixed to the other end of the plate. The return device is a helical spring 26.

The stacker comprise an articulated flap 8 at the stacker inlet the functions of which are:

- to maintain the documents on edge and in contact with each other, the documents being held also by the mobile wall 4, during manipulation of the removable stacker,
- to retract when the documents are transferred out of the removable stacker.

Returning to the previous numerical example, the flap 8 is a metal plate 50×150×2 mm. A magnet is used to hold the flap in the vertical position during manipulation of the removable stacker. It may be adhesively bonded to the flap and cooperate with the angle-bracket 7 which in this case is made from a magnetic material; alternatively, the magnet is fixed to the angle-bracket 7 and it is the flap which is made at least in part from a magnetic material. The magnet is represented by the dashed outline rectangle 8A in the figures.

The final component of the stacker is a tamping edge 10 running along the same longer side of the plate as the rod 6; it provides a physical abutment for each document entering the stacker and guarantees neat stacking.

The stacker has a second handle in the form of a metal plate 11 perpendicular to the plate 1 and fixed to it along the same longer side as the rod 6. It incorporates a hole 12 for the fingers of one hand to be passed through.

Figure 2:
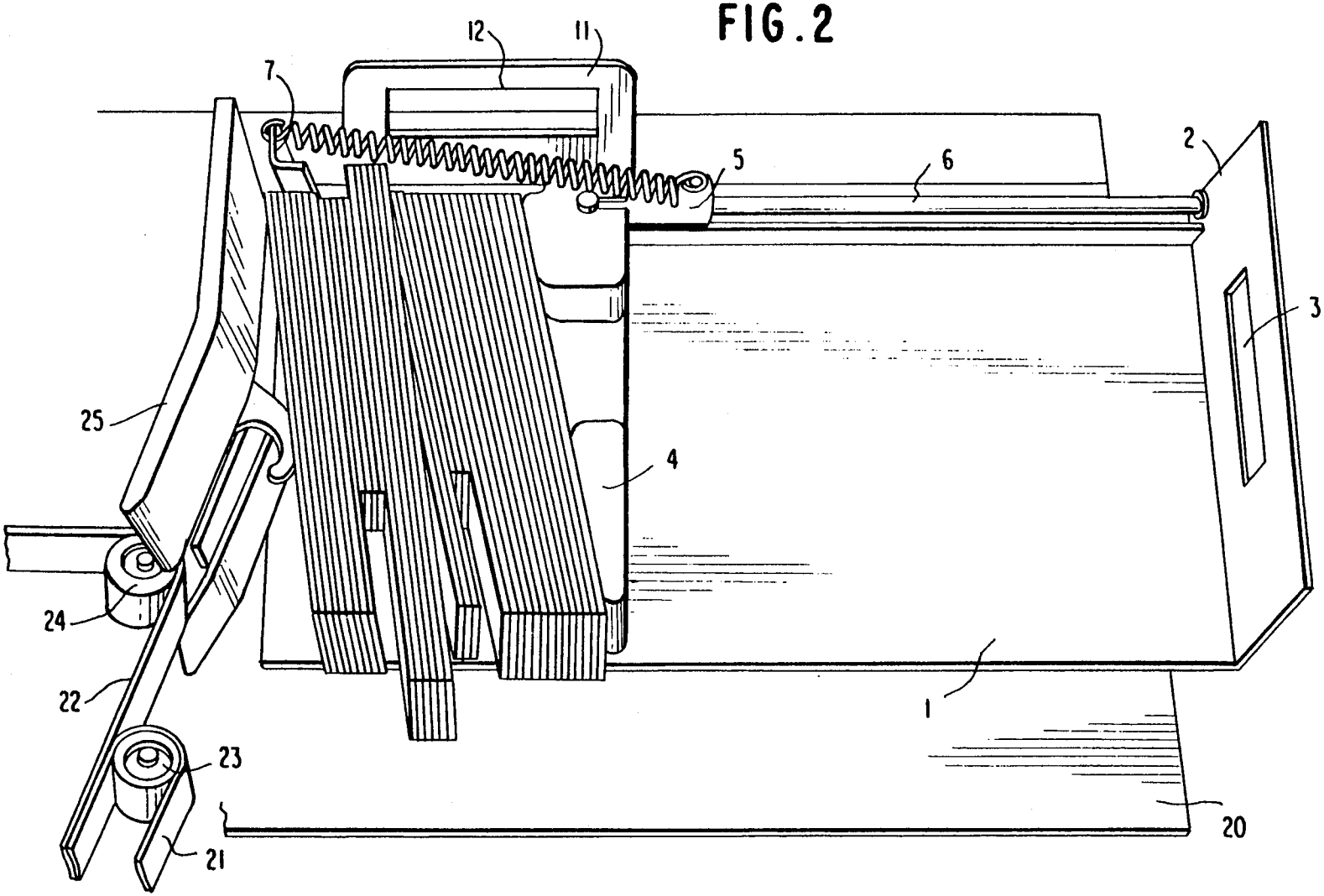
FIG. 2 is a perspective view of the stacker during stacking of documents in it.

The stacker operates as follows: before the empty stacker (FIG. 1) is placed in the sorting system (FIG. 2), the flap is folded down by exerting on its upper part a force greater than that of the magnet; the flap being then in the same plane as the plate 1 of the stacker, the stacker is placed on the sorting system of which FIG. 2 shows only the stacker support 20, the feed belts 21 and 22 running around pulleys 23 and 24, the fixed guide flap 25 and the retractable retainer cam 26. A sorting system of this kind is well known and need not be described in more detail.

Figure 3:
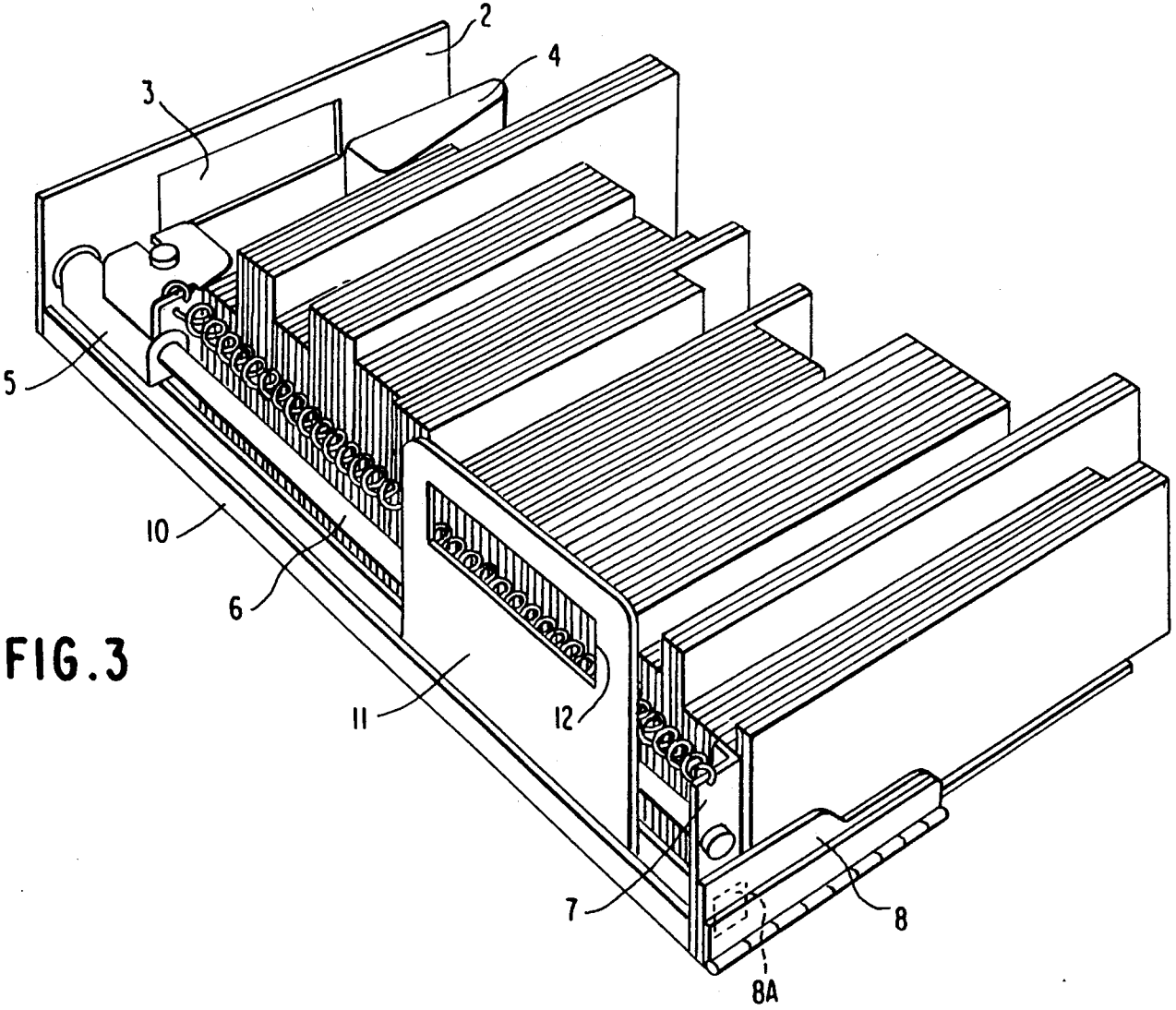
FIG. 3 is a perspective view of the stacker filled with letters and removed from the system.

When stacking is completed the stacker is removed from the system and the flap 8 is folded up, so ensuring that the order of the documents is preserved (FIG. 3).

Figure 4:
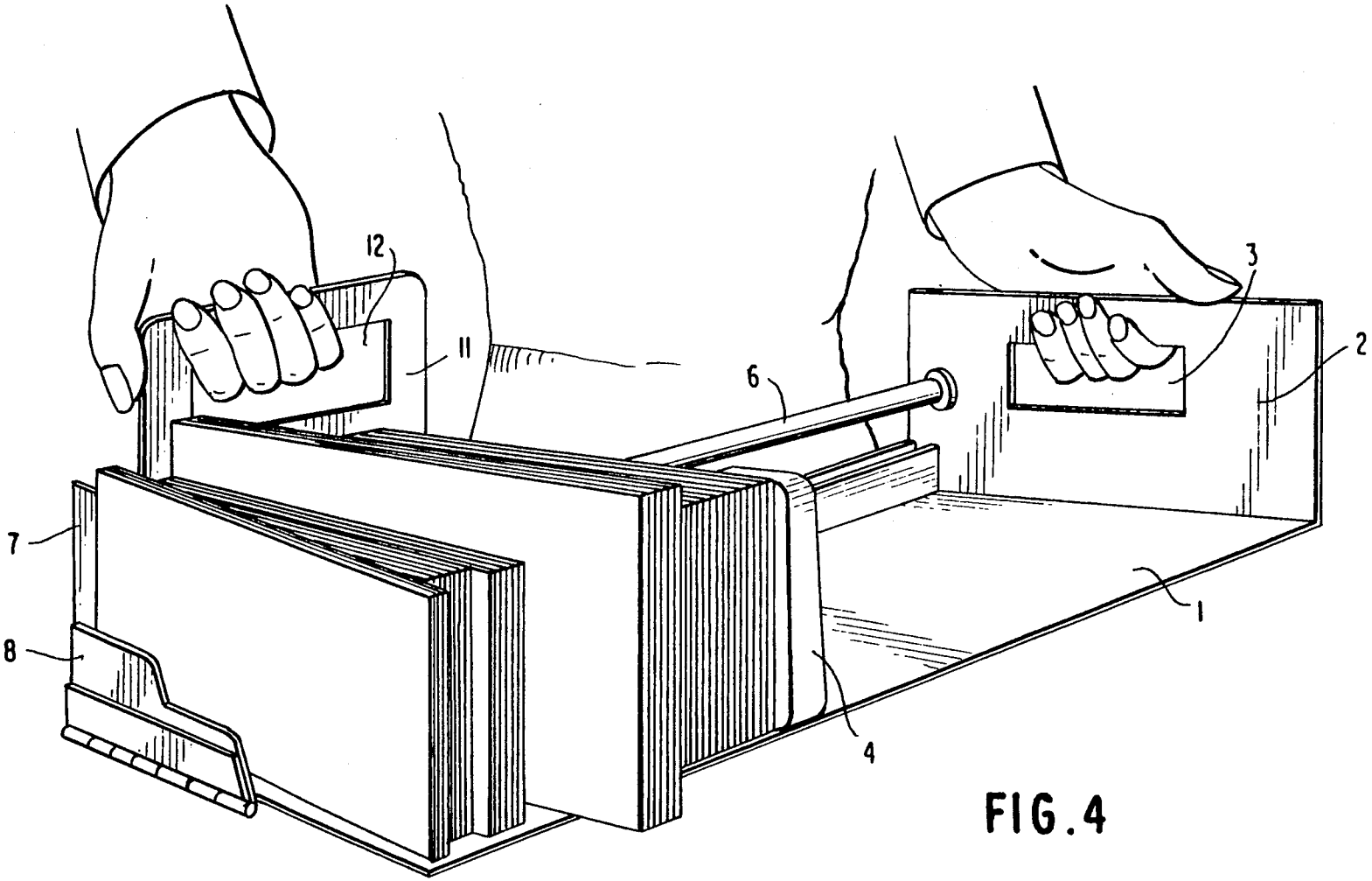
FIG. 4 shows how the stacker is transported from one station to another.

The stacker can then be manipulated and transferred either to the feed magazine of the sorting system for a subsequent sorting pass or to the boxes or bags used by the mailmen (FIG. 4).

The invention applies to the equipment of small sorting centers, in particular for delivery preparation.

There is claimed:

1. Removable stacker for an automatic mail sorting system comprising a flat rectangular plate defining a stacking area, a mobile wall at right angles to said plate and movable across the plate in a direction of a stacker inlet at a edge of the plate and adapted to contact documents on edge on said plate, a return device operatively coupled to said mobile wall for moving said mobile wall in a direction opposite to the direction of movement of said documents as the stacker is filled from the stacker inlet toward the mobile wall, and an articulated flap coupled to said plate and pivotable between a first position in line with the plate to a second position at right angles to the plate and closing off said inlet and for contacting a stack of said documents to an opposite side of a stack of documents from that of said mobile wall to grip said documents during manipulation of the removable stacker, and said stacker further comprising means for maintaining said flap in said second position against the action of the weight of the stacked documents pressed against the flap by said return device acting on said mobile wall.

2. Stacker according to claim 1 wherein said flap maintaining means comprise a magnet fixed to said flap and a magnetic member operatively fixed to said plate and magnetically attracting said magnet when said flap is in said second position.

3. Stacker according to claim 1 wherein said flap maintaining means comprise a magnet carried by a member operatively fixed to said plate and facing a part of said flap is in said second position, and wherein at least said part of said flap is made of a magnetic material.

4. Stacker according to claim 1 further comprising at least one manipulator handle operatively fixed to said plate and extending at right angles thereto.

* * * * *